US005566652A

United States Patent [19]

Deppe

[11] Patent Number: 5,566,652

[45] Date of Patent: Oct. 22, 1996

[54] LIGHT WEIGHT CAM FOLLOWER

[75] Inventor: David W. Deppe, Marshall, Mich.

[73] Assignee: Eaton Corporation, Cleveland, Ohio

[21] Appl. No.: 540,606

[22] Filed: Oct. 6, 1995

[51] Int. Cl.[6] ..... F01L 1/16; F01L 1/18; F01M 9/10

[52] U.S. Cl. ..... 123/90.35; 123/90.36; 123/90.42; 123/90.5; 74/569

[58] Field of Search ..... 123/90.33, 90.35, 123/90.36, 90.39, 90.41, 90.42, 90.43, 90.46, 90.48, 90.49, 90.5, 90.51, 90.55; 74/569

[56] References Cited

U.S. PATENT DOCUMENTS

| | | | |
|---|---|---|---|
| 1,565,223 | 12/1925 | Church | 123/90.5 |
| 4,204,814 | 5/1980 | Matzen | 417/437 |
| 4,335,685 | 6/1982 | Clouse | 123/90.5 |
| 4,589,383 | 5/1986 | Showalter | 123/90.36 |
| 4,909,197 | 3/1990 | Perr | 123/90.48 |
| 5,010,856 | 4/1991 | Ojala | 123/90.36 |
| 5,186,130 | 2/1993 | Melchior | 123/90.35 |
| 5,307,769 | 5/1994 | Meagher et al. | 123/90.5 |

*Primary Examiner*—Weilun Lo
*Attorney, Agent, or Firm*—Frank M. Sajovec

[57] ABSTRACT

A roller cam follower for an internal combustion engine. The cam follower includes a roller assembly consisting of an insert member formed of a conformable plastic material and an axleless roller received in a cavity formed in the insert, the material of the insert closely conforming to the contour of the roller. Various adaptations of the inventive cam follower structure are shown; including a light weight mechanical valve lifter, a hydraulic lash adjuster, a rocker arm and a mechanical direct acting tappet; all of which include means for conducting oil from the exterior of the cam follower to the roller cavity.

7 Claims, 3 Drawing Sheets

LIGHT WEIGHT CAM FOLLOWER

The present invention relates generally to valve gear for internal combustion engines, and more particularly to a light-weight, low-friction cam follower for such an engine.

As the need for improved fuel economy in internal combustion engines continues, so does the need for reducing the weight of engine components, including valve gear components. In valve gear using a roller cam follower in one way or another, the adoption of an axleless roller which relies on hydrodynamic forces for load support can contribute significantly to meeting this objective. Axleless roller followers are known in the art, as shown by U.S. Pat. No. 5,186,130; however, such cam follower assemblies are difficult to manufacture economically, caused at least in part by the extreme precision required at the interface between the roller and the cavity in which it is received, particularly in an all metal structure which must operate under varying load conditions. Certain of the problems can be overcome by the use of a plastic insert between the follower body and the insert, such as that shown in U.S. Pat. No. 5,010,856, which discloses a roller cam follower which incorporates a plastic insert receiving the roller; however, that structure is shown only as applied to a rocker arm wherein the roller engages an overhead cam which permits oil to flow by gravity to the interface between the roller and the cavity formed in the plastic insert. It does not address the use of a plastic insert in an application wherein the cavity is inverted and thus not capable of being supplied oil by gravity flow.

It is accordingly an object of the present invention to provide a cam follower for an internal combustion engine incorporating a light weight axleless roller assembly which can be produced economically.

It is a further object of the invention to provide a roller follower assembly incorporating a plastic insert in which the roller is received and which can be used in any relative orientation of the insert and roller.

A still further and specific object of the invention is to adopt a light weight axleless roller assembly in a light weight tappet assembly as shown in U.S. Pat. No. 5,458,097, which patent is incorporated herein by reference. That application discloses a light weight mechanical valve lifter which is particularly adapted for use in racing engines under the rules of the National Association for Stock Car Auto Racing (NASCAR). Although designed for such specific application it has become apparent that the extremely light weight of that design makes it adaptable to non-racing engine applications, and that even further advantages can be obtained by incorporating a light-weight, low-friction cam contacting element in the form of an axleless roller.

To meet the above objectives the present invention provides an axleless roller which is received within a plastic insert mounted on a cam follower assembly and wherein a supply of pressurized oil at the interface between the roller and the plastic insert is provided. In a specific adaptation of the invention the axleless roller assembly is combined with an extremely light weight mechanical tappet assembly to provide a very low friction, low weight roller tappet.

Other objectives and advantages of the invention will be apparent from the following description when considered in connection with the accompanying drawings, wherein.

Figure 1:
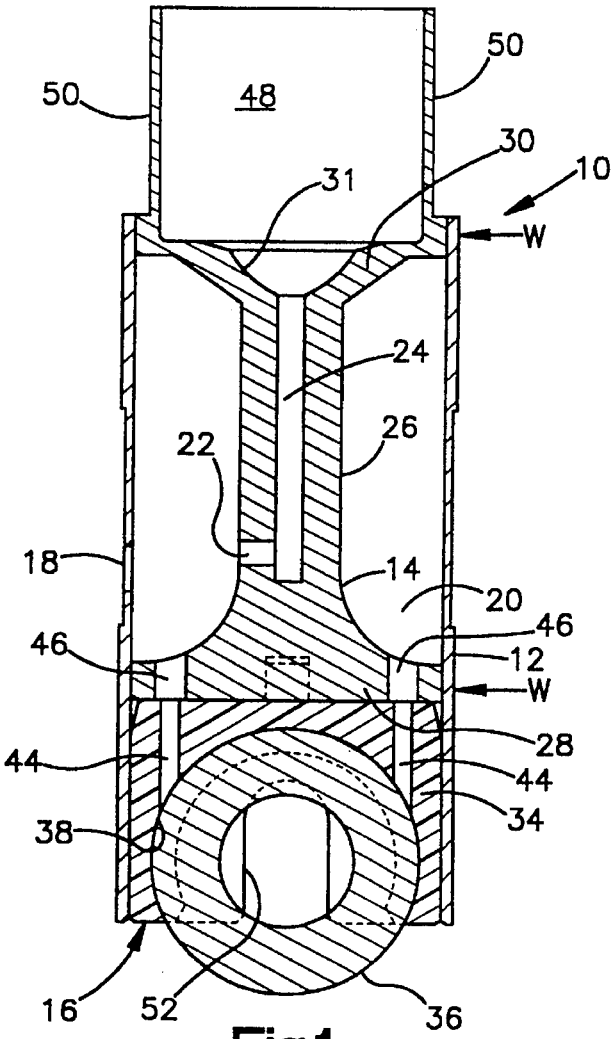
FIG. 1 is a sectional view of a light weight tappet incorporating the invention.
Figure 4C:
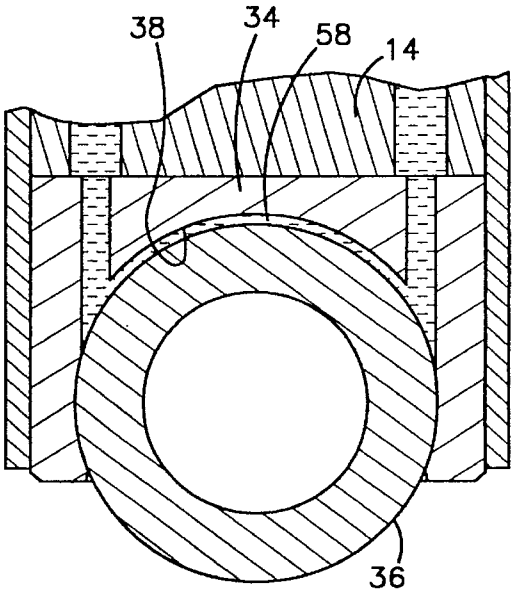
Figure 4B:
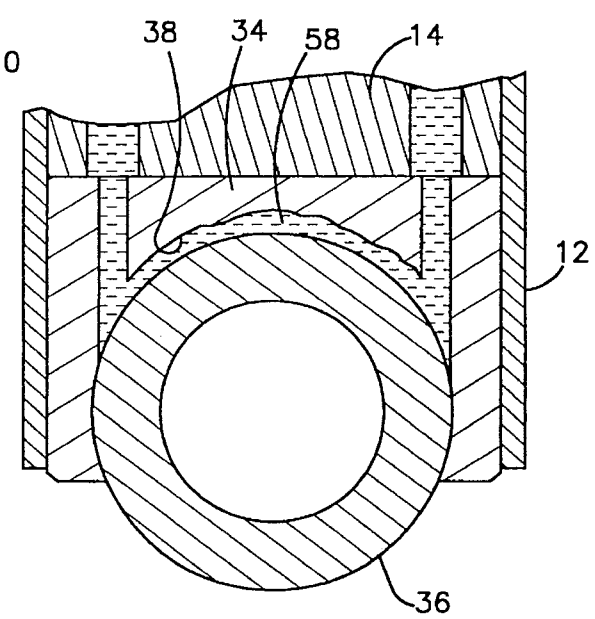
Figure 4A:
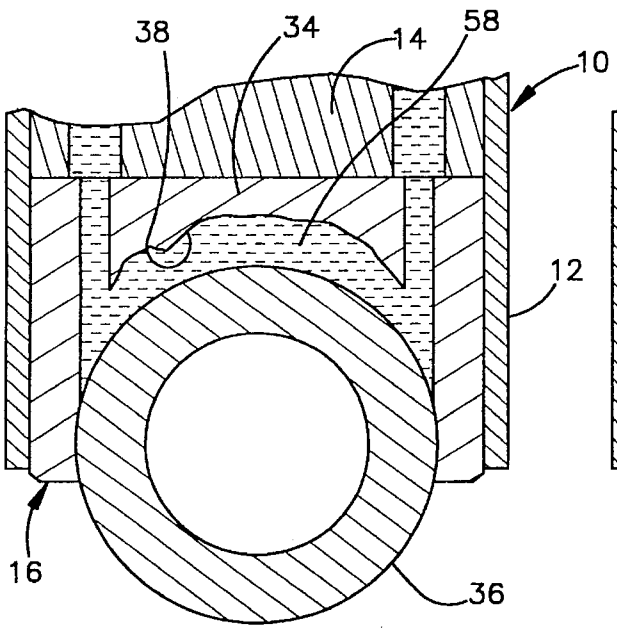

FIGS. 4A, B and C are partial sectional views of a portion of the FIG. 1 embodiment shown somewhat schematically, illustrating the effects of loads applied to a roller follower incorporating the invention.

Figure 5:
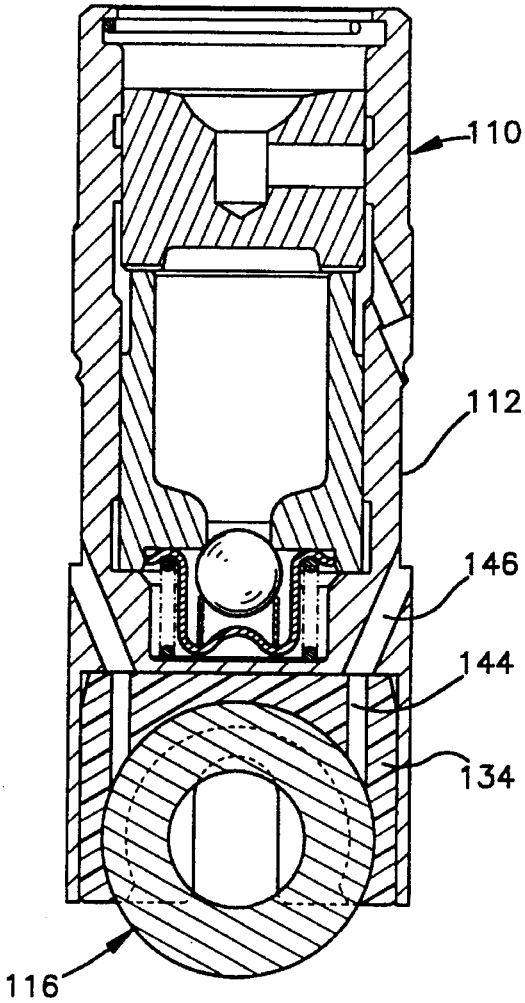
Figure 6:
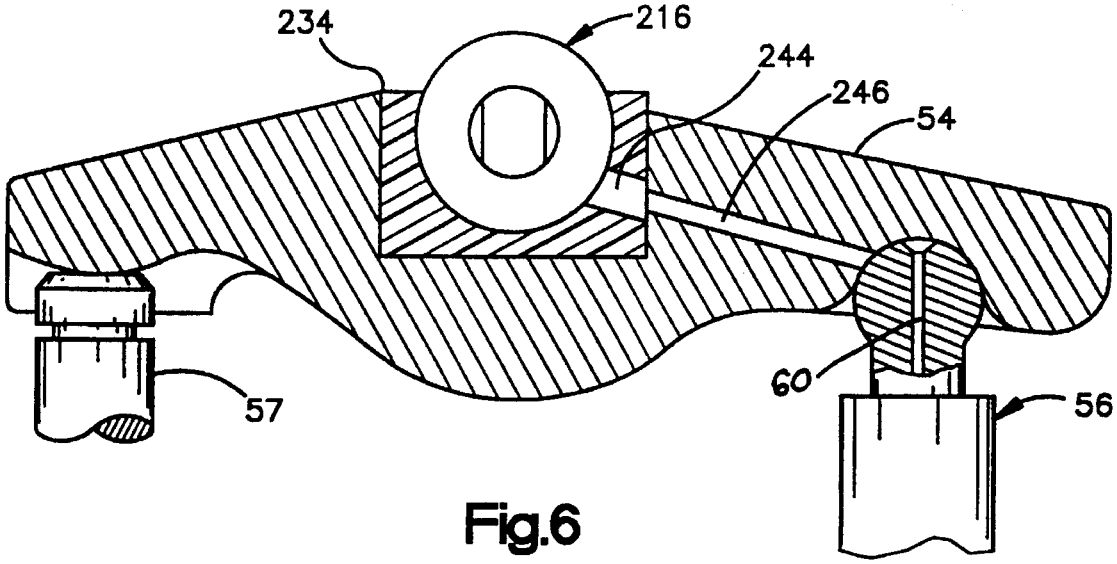
Figure 7:
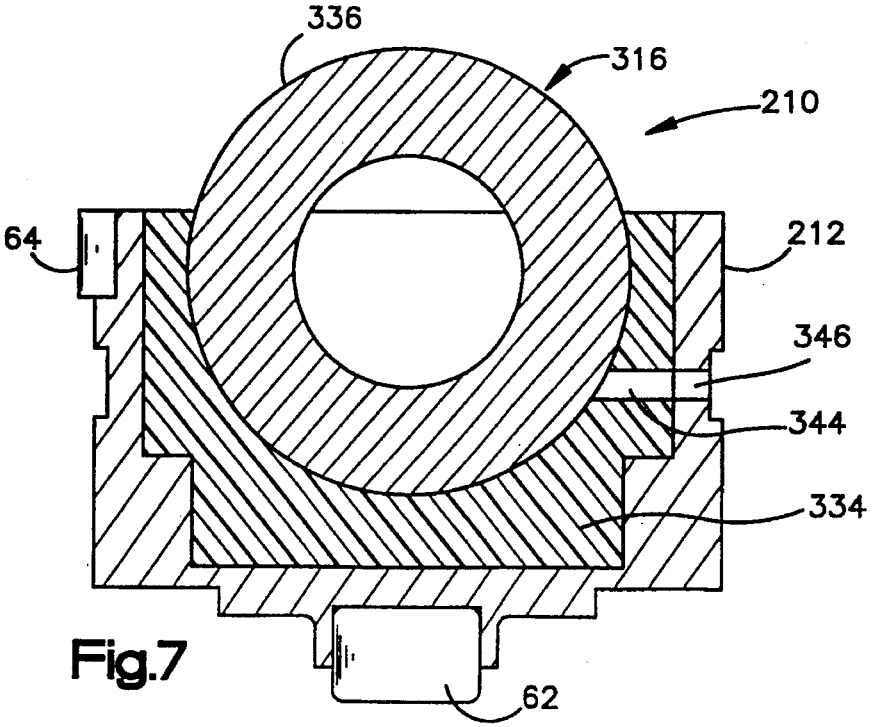

FIG. 5 is a sectional view of a hydraulic lash adjuster incorporating the roller assembly of the invention;

FIG. 6 is a sectional view of a rocker arm incorporating the roller assembly of the invention; and FIG. 7 is a sectional view of a direct acting tappet incorporating the invention.

Referring to FIG. 1, there is illustrated a valve lifter 10 comprising a thin-walled cylindrical member 12, a pedestal member 14 received within the cylinder, and a roller assembly 16 received within the cylindrical member and in engagement with the pedestal. The valve lifter is shown generally as installed in sliding relation within an engine block (not shown) in a conventional manner. To provide lubricating oil to the remainder of the valve train components, an oil flow path from a gallery (not shown) within the block is provided through a port 18 formed in the wall of the cylindrical member, an annular chamber 20 formed between the member 12 and the pedestal 14, a radial port 22 formed in the pedestal, and a blind, axial bore 24 formed in the pedestal and intersecting the port 22.

The pedestal 14 is preferably formed of a hardenable steel and includes a central core 26 which flares out into a head portion 28 and a pushrod-engaging portion 30, which also flares outward from the core and includes a socket 31 which is engaged by a valve actuating pushrod (not shown).

The cylindrical member 12 is a thin-walled cylinder preferably formed of a hardenable steel which is welded to the pedestal 14 in the areas designated by the arrows W. The cylindrical member extends beyond the head portion 28 of the pedestal 14 to receive the roller assembly 16.

Figure 3:
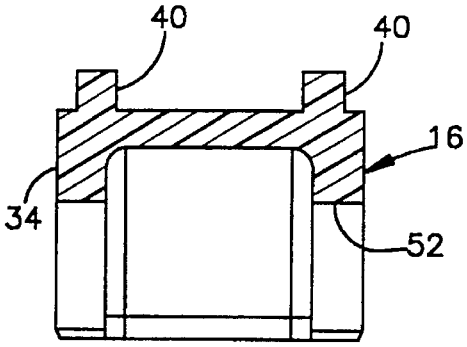
FIG. 3 is a sectional view of a component of the embodiment shown in FIG. 1, taken at line 3—3 of FIG. 2.

The roller assembly 16 comprises a body or insert 34 preferably molded of a plastic material, and a metallic roller 36 which is received in an arcuate cavity 38 formed in the body. As shown in FIG. 3, the body is formed with cylindrical protrusions 40 which are received in corresponding cavities formed in the pedestal to align the roller assembly within the cylindrical member 12 such that oil ports 44 formed through the body 34 and opening into the cavity 38, are aligned with oil ports 46 formed in the pedestal. A cylindrical extension 48 is formed on the pushrod engaging portion 30, with flats 50 formed thereon for engagement by a plate or the like (not shown) which can be fixed to the engine or linked to other valve lifters to maintain the alignment of the roller with the cam, as is well known in the art.

Figure 2:
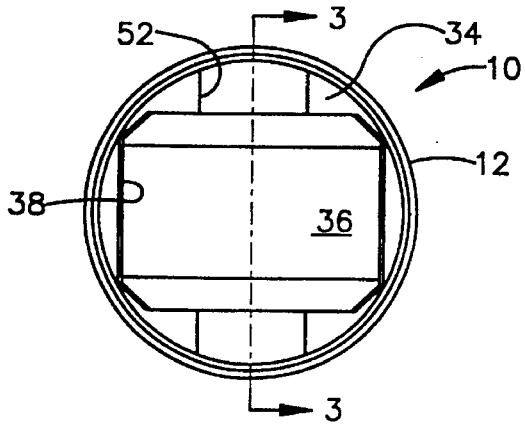
FIG. 2 is a bottom plan view of the tappet shown in FIG. 1.

As shown in FIG. 2, the roller cavity 38 partially surrounds the roller,extending along a circle in excess of 180°; therefore, the roller must be pressed into the body and is retained therein by the surrounding portion of the cavity wall. To facilitate the insertion of the roller into the cavity, the body has a transverse slot 52 formed through it parallel to the roller axis so that the body can be deflected sufficiently to insert the roller prior to assembly into the cylindrical assembly 12. The roller is a close fit within the cavity 38, and the material for the body is selected for its ability to conform to the contour of the roller when the lifter 10 is under load, with nylon being a preferred example. In testing, a 4–6 nylon with glass reinforcement has been particularly effective. To further reduce weight, the roller is preferably hollow, as shown.

Although the roller assembly 16 will be retained within the cylindrical member 12 by engagement with the cam and the pushrod when the lifter is installed in an engine, it is preferably lightly press fit into the cylindrical member to provide a self-contained unit for shipment and handling prior to final assembly.

As indicated above, the use of a plastic insert in a cam follower in an internal combustion has only been suggested rather recently, and then only in a rocker arm wherein oil can be fed by gravity. This lack of use possibly results from a perception that the need for extremely close fits and tolerances in the known metal-to-metal application of an axleless roller necessarily eliminated a less rigid material such as nylon, particularly in a high load application. Applicants have found, however, that the resilience of plastic and its ability to conform to a mating surface is advantageous in the present application, as is illustrated in schematic form in FIGS. 4A–4C wherein the valve lifter 10 of FIG. 1 is shown, with surfaces and clearances exaggerated, in an unloaded or lightly loaded condition in FIG. 4A, in a moderately loaded condition in FIG. 4B and in a heavily loaded condition in FIG. 4C. Conventional thinking might conclude that without prohibitively precise machining of the cavity 38 the cushion of oil 58 between the roller 36 and the insert 34, which is readily maintained under light and moderate loads, cannot be maintained under heavy load due to irregularities in the cavity surface. However, tests conducted by the applicant herein have shown that so long as normal engine oil pressure is maintained at the roller/insert interface, the plastic interface conforms more closely to the roller surface as the load increases, such that under normal internal combustion engine valve train loads and under normal operating oil pressure (around 20 psi), the oil cushion 58 will be maintained.

Although the present invention is most advantageously applied to the lightweight mechanical valve lifter illustrated in FIGS. 1–4, it also can be applied to other cam follower applications. As shown in FIG. 5, a roller assembly 116 is received within the body 112 of a hydraulic valve lifter 110, with oil ports 144 in the insert body 134 being fed pressurized oil from an engine gallery (not shown) through ports 146 formed in the tappet body. In FIG. 6, a roller assembly 216 is received within a rocker arm 54, as used in a valve train wherein the rocker arm is pivotally mounted on a stationary lash adjuster 56 to actuate a valve 57, the roller assembly 216 being acted on by an overhead cam (not shown). In this embodiment an oil port 244 in plastic insert 234 is aligned with a passage 246 in the rocker arm body, which receives pressurized oil from a metered oil port 60 formed in the output member of the lash adjuster 56 via the ball and socket connection between the rocker arm and the lash adjuster. FIG. 7 illustrates a mechanical direct acting tappet 210 wherein a roller assembly 316 is received in a tappet body 212, with a port 344 formed in a plastic insert 334 being fed pressurized oil from an engine oil gallery (not shown) by means of a port 346 formed in the tappet body. In the embodiment illustrated a cam (not shown) acts directly on the roller 336, with valve train lash being set by means of the select fitting of a plug 62 which contacts the engine valve (not shown). Alignment of the tappet with the cam is maintained by means of a pin 64 received in alignable slots formed in the body 212 and in the head of the engine (not shown).

I claim:

1. A cam follower for an internal combustion engine comprising a body; a cam follower element received within said body; and a force transmitting surface on said body, said force transmitting surface being effective to transmit a valve opening force applied to said cam follower element to a poppet valve of said engine; said cam follower element comprising a plastic insert member received in said body and having a generally semi-cylindrical cavity formed therein, and an axleless roller received within said cavity, said insert member being conformable under load to the surface of said roller; and means formed within said insert member for conducting pressurized engine oil from a source external to said cam follower to said cavity.

2. Apparatus as claimed in claim 1, in which said cam followers comprises a mechanical valve lifter wherein said body is defined by a thin-walled cylindrical member in which said plastic insert member is received; a substantially solid pedestal member received within and fixed to said cylindrical member, said pedestal member having first and second spaced-apart radially outwardly extending portions formed thereon in engagement with said cylindrical member with said first radially outwardly extending portion in engagement with said plastic insert member and said second radially outwardly extending portion having a pushrod contacting surface formed thereon.

3. Apparatus as claimed in claim 2, including alignment means formed on said pedestal member and on said plastic insert member to define a predetermined angular orientation of said plastic insert member within said cylindrical member.

4. Apparatus as claimed in claim 3, in which said alignment means comprises one or more projections formed on said plastic insert member received in corresponding openings formed in said pedestal member.

5. Apparatus as claimed in claim 1, in which said body defines a hydraulic tappet having a movable plunger received therein, said force transmitting surface being formed on said plunger.

6. Apparatus as claimed in claim 1, in which said cam follower comprises a rocker arm having a valve contacting surface defining said force transmitting surface formed at one end thereof and a socket formed at the opposite end, said socket being engageable with an output member of a lash adjuster, said means for conducting oil comprising a port formed in said rocker arm intersecting the surface of said socket.

7. Apparatus as claimed in any one of claims 1 through 6, in which said plastic body member is formed of nylon.

* * * * *